US010674878B2

(12) United States Patent
Kaweblum et al.

(10) Patent No.: US 10,674,878 B2
(45) Date of Patent: Jun. 9, 2020

(54) PAPER ROLL COVER

(71) Applicant: Rollmate LLC, Hollywood, FL (US)

(72) Inventors: Jonathan Kaweblum, Hollywood, FL (US); Adam Bender, Delray Beach, FL (US)

(73) Assignee: Rollmate LLC, Hollywood, FL (US)

( * ) Notice: Subject to any disclaimer, the term of this patent is extended or adjusted under 35 U.S.C. 154(b) by 277 days.

(21) Appl. No.: 15/796,966

(22) Filed: Oct. 30, 2017

(65) Prior Publication Data

US 2019/0125140 A1 May 2, 2019

(51) Int. Cl.
*A47K 10/22* (2006.01)
*A47K 10/38* (2006.01)
*A47K 10/32* (2006.01)

(52) U.S. Cl.
CPC ..... *A47K 10/22* (2013.01); *A47K 10/38* (2013.01); *A47K 2010/3233* (2013.01); *A47K 2010/3253* (2013.01); *A47K 2010/389* (2013.01)

(58) Field of Classification Search
CPC .. A47K 10/22; A47K 10/38; A47K 2010/389; A47K 2010/3233; A47K 2010/3253
See application file for complete search history.

(56) References Cited

U.S. PATENT DOCUMENTS 2,106,363 A * 1/1938 Tesher ..... A47K 10/22 225/42
2,275,787 A 3/1942 Medoff
2,462,776 A * 2/1949 Price ..... A47K 10/22 225/33
2,649,255 A 8/1953 Smallen
3,467,456 A * 9/1969 Chmela ..... A47K 10/40 312/34.24
4,427,159 A * 1/1984 Miller ..... A47K 10/38 242/560
4,614,312 A 9/1986 Del Pino
4,721,264 A * 1/1988 Muscarello ..... A47K 10/38 206/390
2007/0080256 A1* 4/2007 Collins ..... A47K 10/40 242/598.6
2008/0142542 A1* 6/2008 Petry ..... A47K 10/38 221/283
2009/0072064 A1* 3/2009 Gabor ..... A47K 10/38 242/160.3
2011/0248114 A1* 10/2011 Ghetia ..... A47K 10/22 242/615
2016/0324375 A1* 11/2016 Martorelli, II ..... A47K 10/3827

* cited by examiner

*Primary Examiner* — William A. Rivera
(74) *Attorney, Agent, or Firm* — Pablo Meles; Gray Robinson, PA

(57) ABSTRACT

A paper roll cover includes a cover member, a left side wall having a plurality of apertures peripherally around a central large aperture, a right side wall having a plurality of apertures peripherally around a central large aperture, and where the left side wall is arranged and configured to reside on a left side of the cover member and the right side wall is arranged and configured to reside a right side of the cover member. In some embodiments, the plurality of apertures in the right side wall or the left side wall are configured to fit pegs to adjust the paper cover roll to brackets mounted on a wall and alternatively to a stand alone paper roll stand.

20 Claims, 6 Drawing Sheets

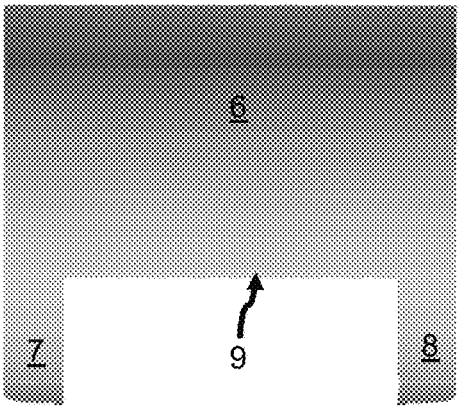
10 FIG. 4
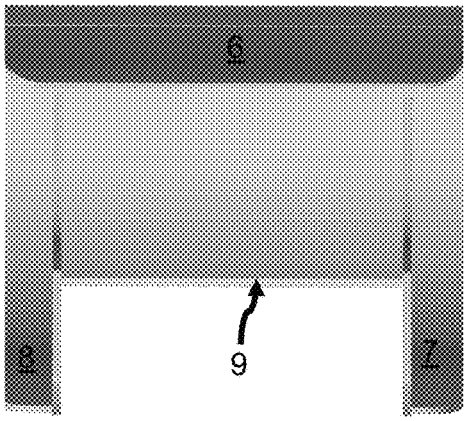
10 FIG. 5
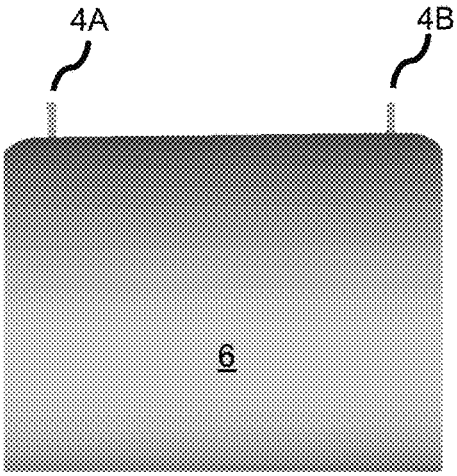
10 FIG. 6
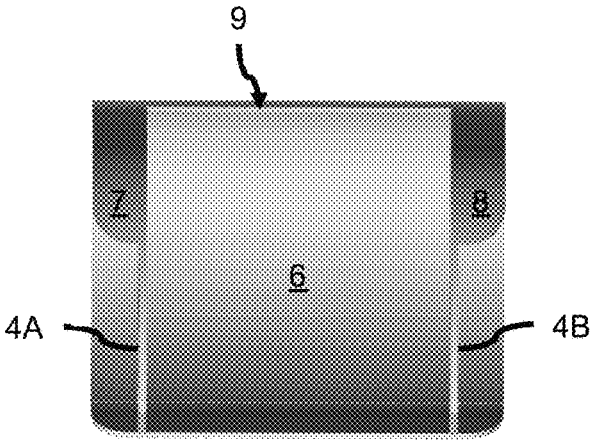
10 FIG. 7

PAPER ROLL COVER

CROSS-REFERENCE TO RELATED APPLICATIONS

N/A

FIELD OF THE DISCLOSURE

The present disclosure generally relates to systems and methods in the field of bathroom accessories, and more particularly relates to a protective cover for use with paper rolls including toilet paper rolls mounted on fixed and stand-alone paper roll dispensers.

BACKGROUND

Paper roll dispensers and paper towel dispensers are frequently mounted within walls in bathrooms adjacent to toilets for toilet paper and in kitchens for paper towels. Paper roll dispensers also come in many configurations on such walls and on stand alone dispensers. Conventional toilet paper dispensers often include a spindle mounted between two posts that are mounted to a wall. Such paper roll dispensers fail to include covers for the paper rolls, thereby exposing the toilet paper to becoming soiled, and subject to transmitted infections and airborne germs. Additional problems include excess paper rolling off of the roll and not being able to tear paper off of a roll using only one hand. Furthermore, since paper roll dispensers now come in such a variety of configurations, many existing paper roll covers fail to adequately fit or accommodate for such variation.

SUMMARY

In some embodiments, a paper roll covers includes a cover member, a left side wall having a plurality of apertures peripherally around a central large aperture, a right side wall having a plurality of apertures peripherally around a central large aperture, and where the left side wall is arranged and configured to attach to or to reside on a left side of the cover member and the right side wall is arranged and configured to attach to or to reside a right side of the cover member. In some embodiments, the plurality of apertures in the right side wall or the left side wall are configured to fit pegs to adjust the paper cover roll to brackets mounted on a wall and alternatively to a stand alone paper roll stand.

BRIEF DESCRIPTION OF DRAWINGS

FIG. 4 illustrates a front plan view of the paper roll cover of FIG. 1 in accordance with an embodiment of the disclosure;

FIG. 5 illustrates a rear plan view of the paper roll cover of FIG. 1 in accordance with an embodiment of the disclosure;

FIG. 6 illustrates a top plan view of the paper roll cover of FIG. 1 in accordance with an embodiment of the disclosure;

FIG. 7 illustrates a bottom plan view of the paper roll cover of FIG. 1 in accordance with an embodiment of the disclosure;

DETAILED DESCRIPTION

Glossary of Terms

Cavity—is an empty space or volume.

Unitary piece—is a number of portions of an apparatus or device made from a single piece of material such as a single piece of molded or 3-D printed plastic or other material. A unitary piece can also include an apparatus or device that is double-shot molded.

Paper roll cover—is a cover for a roll such as a toilet paper roll or a paper towel roll.

Described herein is a paper roll cover that can be embodied in numerous forms to accommodate toilet paper rolls or paper towel rolls or other forms of paper rolls. The paper roll cover can accommodate a variety of environments that include fixed brackets mounted on a wall or stand alone paper roll stands. In the following description, numerous specific details are set forth in order to provide a thorough understanding of various embodiments of the paper roll cover. It will be apparent, however, to one skilled in the art that embodiments herein may be practiced without some or all of these specific details. In other instances, well known steps and/or structures have not been described in order to not unnecessarily obscure the embodiments of the paper roll cover.

Unless otherwise indicated, all numbers expressing quantities, conditions, and the like in the instant disclosure and claims are to be understood as modified in all instances by the term "about." The term "about" refers, for example, to numerical values covering a range of plus or minus 10% of the numerical value. The modifier "about" used in combination with a quantity is inclusive of the stated value.

In this specification and the claims that follow, singular forms such as "a", "an", and "the" include plural forms unless the content clearly dictates otherwise.

In some embodiments, the paper roll cover according to the present disclosure may be assembled from multiple pieces or elements or in other embodiments the paper roll cover can be made from a unitary piece. The unitary piece can be made from a single material such as plastic or can also be made of multiple materials such as coated plastic or coated metal. As noted previously, the paper roll cover is adjustable or can otherwise be configured to cover a paper roll that is mounted on a wall fixture such as brackets or configured to cover a paper roll mounted on a stand alone paper roll stand. In some embodiments, the paper roll cover can be universal in placement on both fixed and free-standing paper roll dispensers and further tailored externally with various designs that can complement or match the decor of a user's environment (e.g, bathroom or kitchen). Furthermore, the paper roll cover can easily mount on any dispenser without use of tools or additional accessories or modifications, thus enhancing its universality.

Figure 1:
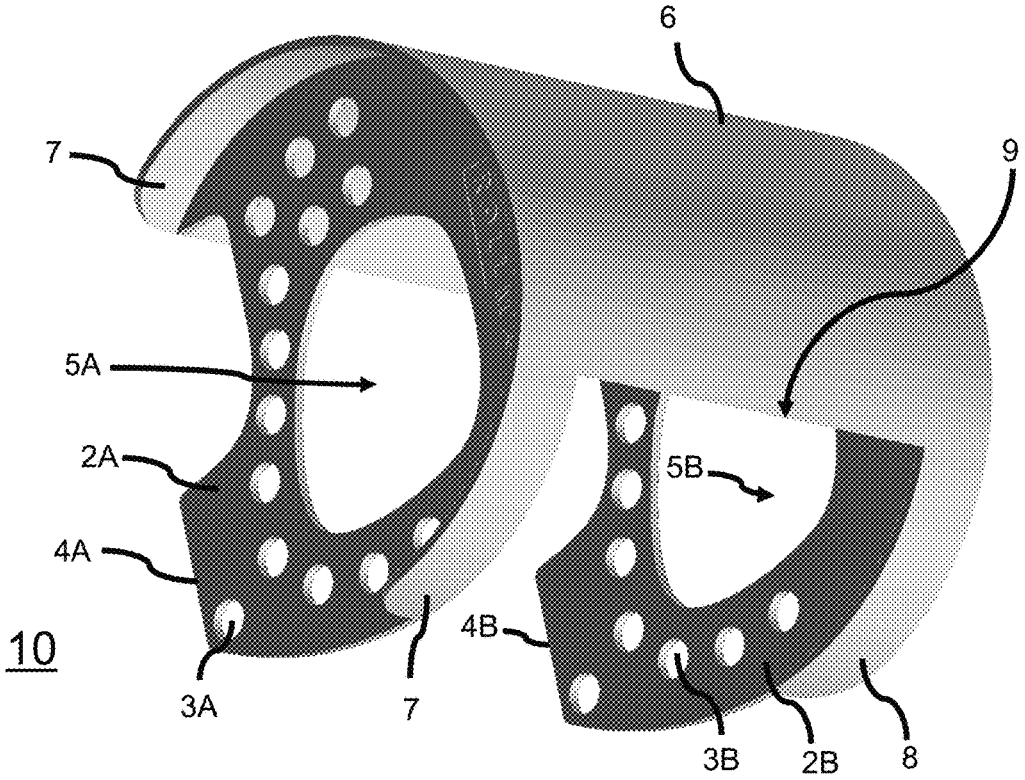
FIG. 1 illustrates a front left perspective view of a paper roll cover according to one embodiment of the disclosure.

In some embodiments and referring to FIG. 1, a paper roll cover 10 includes a cover member 6 having a left side wall 2A having a plurality of apertures or peg holes 3A substantially around or peripherally around a central large aperture 5A. The paper roll cover 10 also includes a right side wall 2B having a plurality of apertures or peg holes 3B substantially around or peripherally around a central large aperture 5B. In some embodiments, the left side wall 2A is configured to attach to a left side of the cover member 6 and the right side wall 2B is configured to attach to a right side of the cover member 6. In some embodiments, rather than attaching the side walls to the cover member, the side walls and cover member forming the paper roll cover form a part of a unitary piece. The paper roll cover accordingly the various embodiments can be made of plastic, polyurethane, rubber, foam, wood, metal, or just about any non-toxic material.

In some embodiments, the left side and the right side walls (2A and 2B) can be arranged and configured to be flush with the corresponding left side of the cover member 6 and the right side of the cover member 6. In some embodiments as shown in FIG. 1, the cover member 6 includes a left overhang portion 7 that overhangs the left side wall 2A and a right overhang portion 8 that overhangs the right side wall 2B. The overhangs are useful to cover up or hide the fixtures or brackets on a wall mounted paper roll fixture as will become more apparent in the explanation of FIGS. 9 and 10. In some embodiments, the left side wall 2A and right side wall 2B each include a vertically flat portion 4A and 4B respectively which can be configured to abut against a wall. Note that the paper roll cover conveniently does not get mounted to the wall, but rather stays mounted on the paper roll by use of gravity and pins or pegs that are inserted into one or more of the plurality of apertures or peg holes 3A and/or 3B. In some embodiments, the cover member can include a horizontal lip portion or cutting edge portion 9 that can facilitate the cutting of paper from a paper roll. The edge can be sharp enough to cut the paper whether the paper roll is perforated or not. In some embodiments, the cover member 6 is arranged and configured to cover approximately 25 percent of a toilet paper roll. In other arrangements the cover member is configured to cover approximately 25 to 35 percent of a paper roll. Ideally, the horizontal lip portion or cutting edge 9 resides at a point where the paper from the paper roll (not shown in FIG. 1) droops vertically downward from the paper roll. In this manner, the paper roll is substantially protected from soiling or wetness and only the drooping portion of the paper roll is exposed below the portion or edge 9 of the cover member 6. In some embodiments, the portion or edge 9 is more particularly configured to facilitate cutting of paper from a toilet paper roll by residing at a point where a toilet paper segment vertically drops off from a toilet paper roll (see FIGS. 10, 12 and 14).

Figure 2:
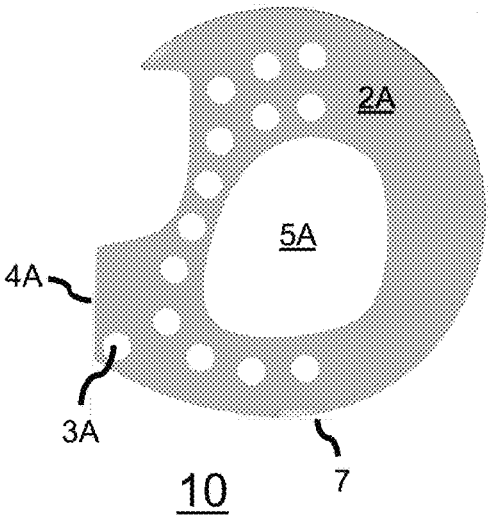
FIG. 2 illustrates a left plan view of a paper roll cover in accordance with the embodiment of the disclosure.
Figure 3:
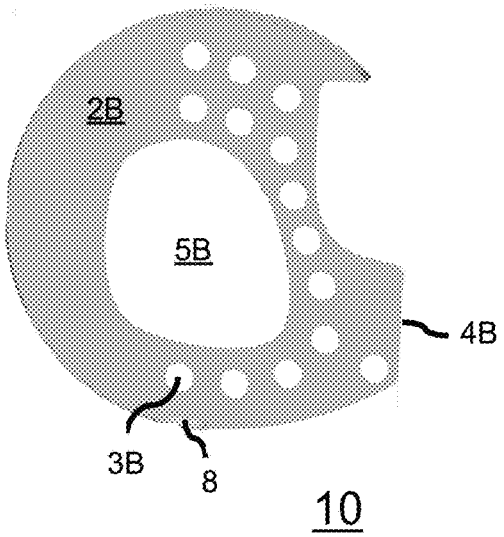
FIG. 3 illustrates a right plan view of the paper roll cover of FIG. 1 in accordance with an embodiment of the disclosure.

In FIGS. 2 and 3, the corresponding left side wall 2A and right side wall 2B are shown including the (respective) plurality of peg holes 3A and 3B in the corresponding left side view of paper roll cover 10 in FIG. 2 and right side view of paper roll cover 10 in FIG. 3. The side view in FIG. 2 further illustrates the overhang portion 7, the vertically flat portion 4A, and the central large aperture 5A and the side view in FIG. 3 illustrates the overhang portion 8, the vertically flat portion 4B, and the central large aperture 5B. Note that the apertures (3A or 3B) peripherally around the central large apertures (5A or 5B) can be two or more and be placed in almost any configurations within contemplation of the embodiments. Generally, the number of apertures are sufficient to adequately accommodate any environment such as a fixed wall mounted bracket environment or any shape of stand-alone paper roll holder or stand. In some embodiments, the apertures (3A and/or 3B) are formed on an upper rear quadrant of the left and right side walls (2A and 2B). In other embodiments, the left side wall and right side wall include at least the plurality of peg holes or apertures formed on an upper half and lower front quadrant of the left and right side walls (2A and 2B). In some embodiments, the plurality of peg holes in the right side wall or the left side wall (2A or 2B) are configured to fit pegs to adjust the paper cover roll 10 to brackets mounted on a wall or to a stand alone paper roll stand (see FIGS. 9, 12, and 14).

Referring to FIG. 4, a front plan view of the paper roll cover 10 illustrates the cover member 6 with its overhang portions 7 and 8 on corresponding left and right sides of the cover member 6. The front plan view also shows the horizontal lip portion or cutting edge 9 from an outside view. FIG. 5 illustrates a rear plan view of the paper roll cover 10 with the cover member 6, overhang portions 7 and 8 on corresponding left and right sides of the cover member 6, as well as the horizontal lip portion or cutting edge 9 from an inside view.

FIG. 6 is a top plan view of the paper roll cover 10 that illustrates the cover member 6 and the vertically flat portions 4A and 4B of the side walls. FIG. 7 is a bottom plan view of the paper roll cover 10 that further illustrates the cover member 6 with its overhang portions 7 and 8, as well as the horizontal lip portion or cutting edge 9. The bottom plan view also shows the vertically flat portions 4A and 4B.

Figure 8:
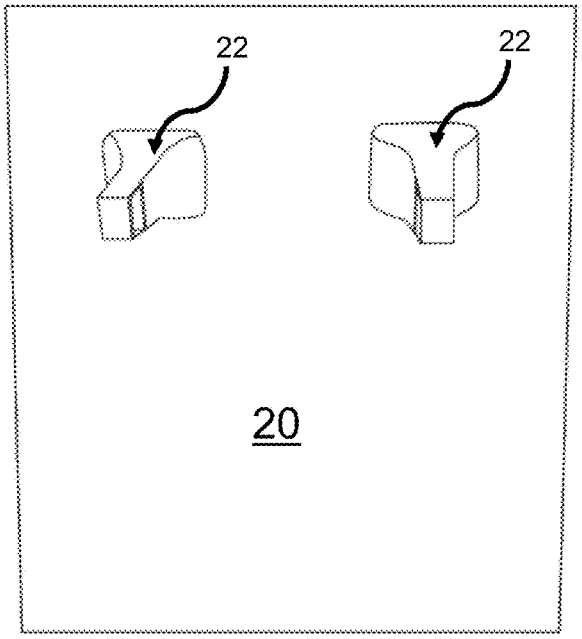
FIG. 8 is a typical wall mounted set of brackets used for a toilet paper roll.
Figure 9:
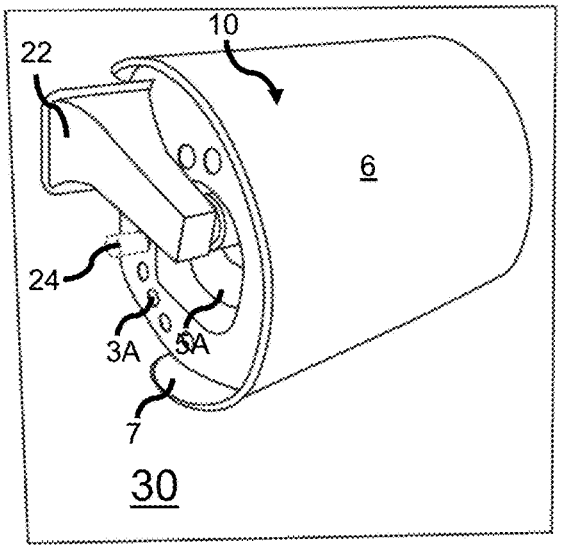
FIG. 9 illustrates the paper roll cover of FIG. 1 used with the wall mounted set of brackets in accordance with an embodiment of the disclosure.

Referring to FIG. 8, a fixture 20 illustrates a typical wall mounted set of brackets 22 used for a toilet paper roll that gets mounted on a spindle (not shown) between the brackets 22. FIG. 9 further illustrates an assembly 30 including the paper roll cover 10 mounted on the fixture 20 using the brackets 22. As in FIG. 1, the paper roll cover 10 in FIG. 9 includes the cover member 6 and side walls with the plurality of apertures 3A surrounding the central large aperture 5A. In the mounting process, the paper roll cover 10 can be placed over the toilet paper roll (not shown) and then the spindle can be fed through the central large aperture 5A (and 5B on the opposing side) before the spindle is mounted on to the brackets 22. An appropriately placed peg 24 can be placed on one of the upper apertures 3A either before the spindle, paper roll, and paper roll cover 10 are mounted on the brackets 22 or after the spindle, paper roll and paper roll cover 10 are mounted on the brackets 22. The single peg 24 on just one (left) side of the paper roll cover 10 or on an opposing (right) side of the paper roll cover 10 can be used or multiple pegs on the opposing sides can be used to maintain the paper roll cover 10 in place mounted on the paper roll. Thus, gravity applies a downward force at the peg 24 and the bracket 22 applies an opposing upward force to maintain the paper roll cover relatively stable. Furthermore, the spindle within the central large apertures 5A and 5B helps to retain the paper roll cover 10 in place and secure to the paper roll as part of the assembly 30. Furthermore, the dimensions of the paper roll cover 10 should be larger than the paper roll it covers, but in some embodiments, the dimensions can be configured to provide a somewhat snug fit that creates some friction, but still enables the roll to dispense the paper without too much force.

Figure 10:
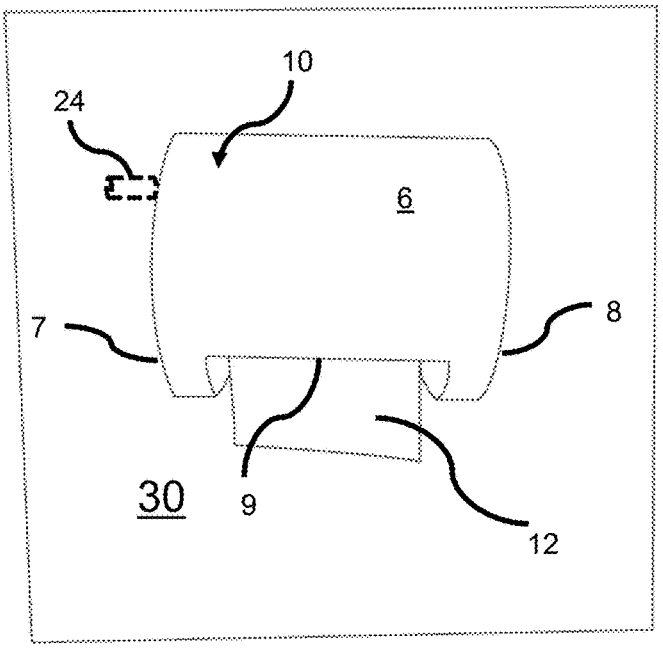
FIG. 10 illustrates a front view of the paper roll cover which further covers the view of the wall mounted set of brackets in accordance with an embodiment of the disclosure.

Referring to FIG. 10, a front plan view of the assembly 30 illustrates that the overhang portions 7 and 8 of the cover member 6 of the paper roll cover 10 further covers the brackets 22 from the view of the observer in front of the assembly 30. In other words, the overhang portions 7 and 8 obscure the view of the brackets 22 when viewed from the front. The observer from the font may still see any portion of the peg 24 that goes beyond the overhang and can further see the paper roll 12 and having a paper segment dropping vertically from the roll at the point where the cutting edge 9 of the cover member 6 resides.

Figure 11:
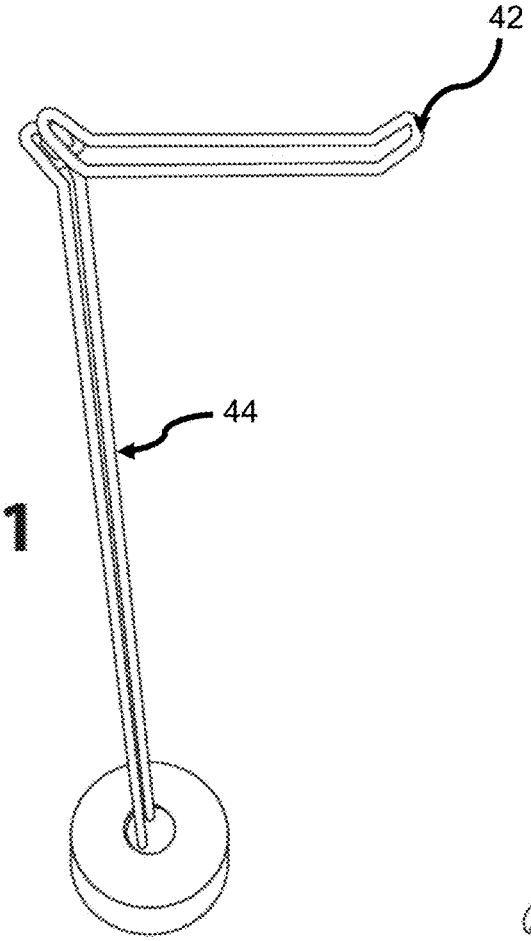
FIG. 11 is a stand alone toilet paper roll stand.
Figure 12:
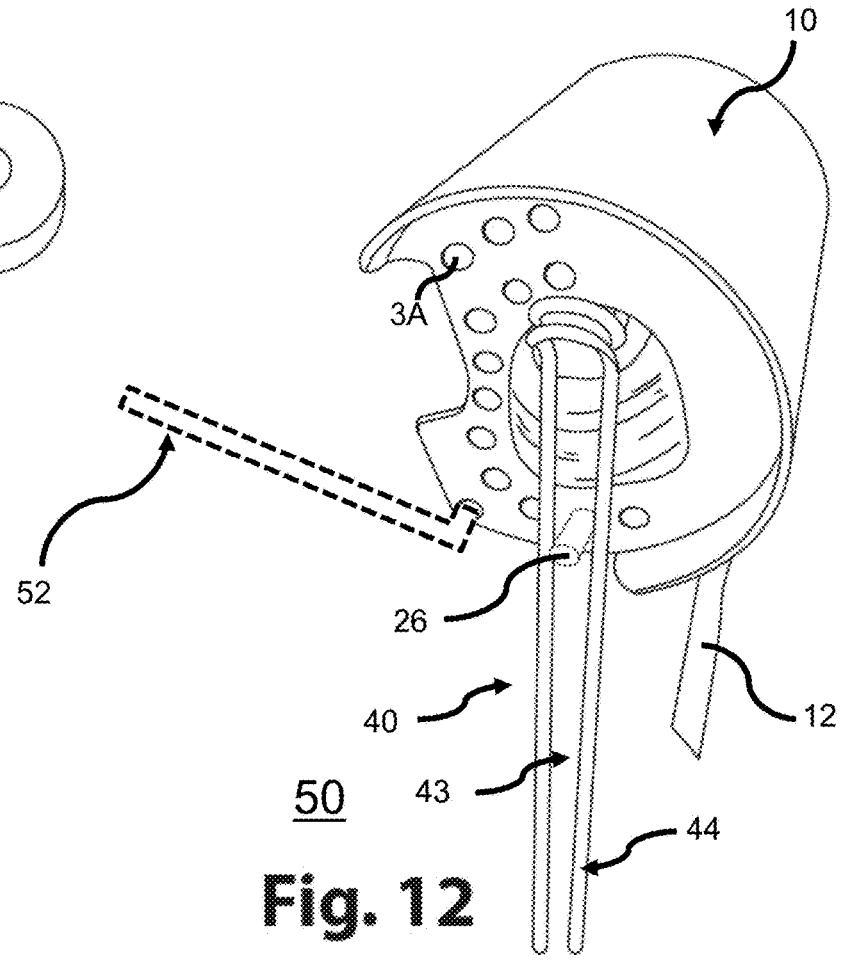
FIG. 12 is the paper roll cover of FIG. 1 used with the stand alone toilet paper roll stand of FIG. 11 in accordance with an embodiment of the disclosure including an accessory.

FIG. 11 illustrates a stand alone toilet paper roll dispenser or holder 40 having a vertical member 44 and a horizontal member 42 that serves as the holding member for the paper roll. The vertical member 44 can be formed by a tube member that is bent or form so that vertical member 44 actually has two parallel members with a gap 43 between the members. The very same paper roll cover 10 of FIGS. 1 and 9 can be used with this stand alone paper roll dispenser or holder 40 as part of an assembly 50 as shown in FIG. 12. Instead of a spindle, the stand-alone toilet paper roll dispenser or holder 40 uses the horizontal member 42 to hold the paper roll 12 along with the paper roll cover 10. To secure the paper roll cover 10 in place, a peg 26 (or the very same peg 24 from FIGS. 9 and 10) can be placed towards the bottom of the side wall of the paper roll cover and placed with the gap 43 of the vertical member 44. As an option, the peg holes or apertures 3A on the left side wall (or 3B on the right side wall as appropriate) can be configured to accommodate a peg 52 that holds other bathroom accessories or items. Such other bathroom accessories or items can hold spare toilet paper rolls, jewelry, keys, phones, wallets, or essentially any item with appropriate modification of the peg 52. In some embodiments, the plurality of pegs can be for insertion into one or more peg holes of the plurality of peg holes in the left side wall or right side wall.

Figure 13:
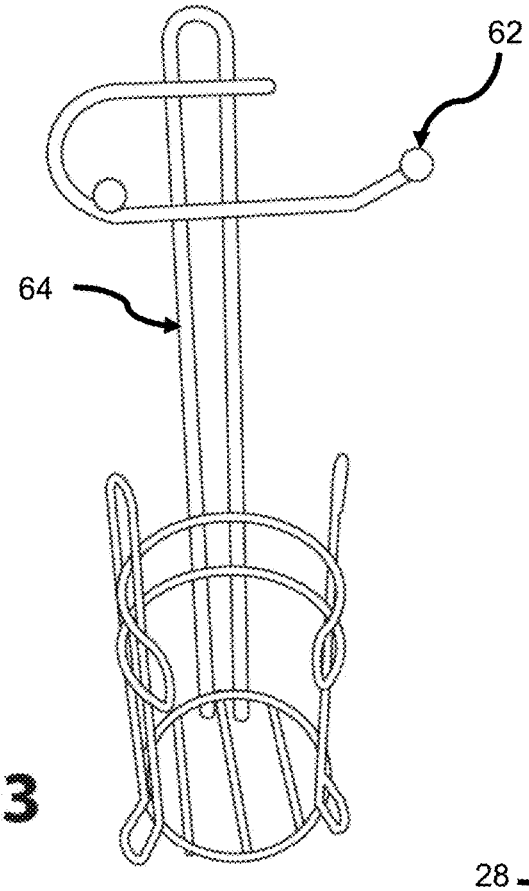
FIG. 13 is another stand alone toilet paper roll stand.
Figure 14:
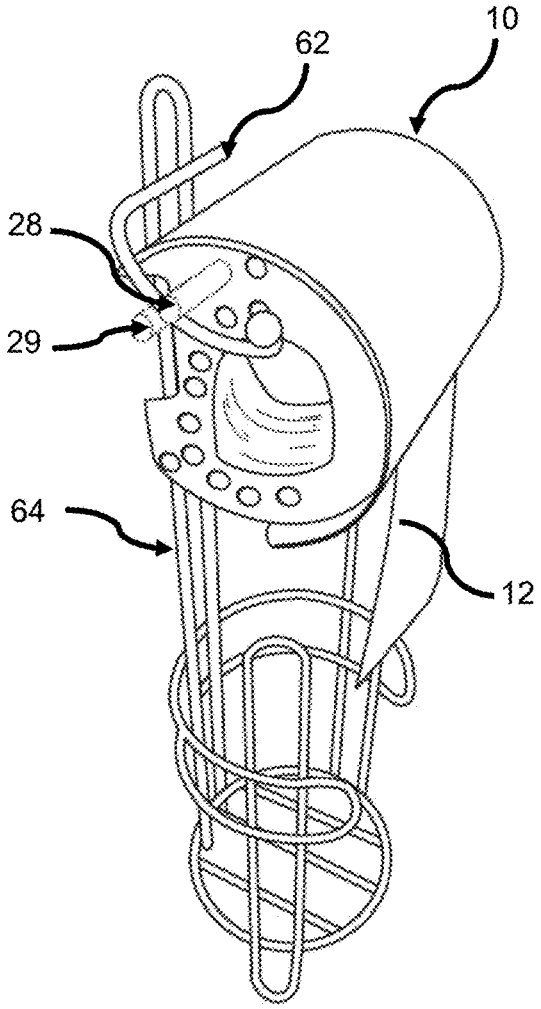
FIG. 14 is the paper roll cover of FIG. 1 used with the stand alone toilet paper roll stand of FIG. 13 in accordance with an embodiment of the disclosure.

Further note that the same paper roll cover 10 can accommodate any number of stand alone paper roll dispensers including the paper roll dispenser 60 of FIG. 13 which includes a vertical member 64 and a "horizontal" member 62. The "horizontal" member 62 may actually be bent in several directions that are not horizontal, but the portion of the member 62 that holds the paper roll will typically be horizontal. Again, the vertical member 64 can be formed by a tube member that is bent or formed so that vertical member 64 actually has two parallel members with a gap between the members which is not relevant in this embodiment. The very same paper roll cover 10 of FIG. 1, 9, or 12 can be used with this stand alone paper roll dispenser or holder 60 as part of an assembly 70 as shown in FIG. 14. The stand-alone toilet paper roll dispenser or holder 60 uses the horizontal member 62 to hold the paper roll 12 along with the paper roll cover 10. To secure the paper roll cover 10 in place, a pair of pegs 28 and 29 can be placed towards the top of the side wall of the paper roll cover 10 and placed so that a portion of the horizontal member 62 is wedged between the pegs 28 and 29. In some embodiments, the plurality of pegs can be for insertion into one or more peg holes of the plurality of peg holes in the left side wall or right side wall as needed for a particular configuration of dispenser.

Figure 15:
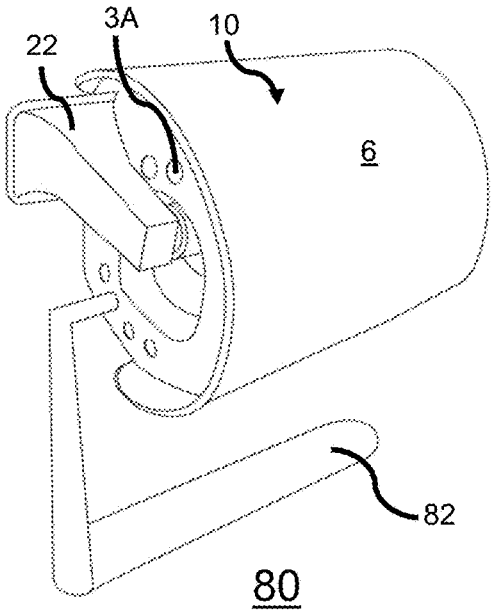
FIG. 15 is the paper roll cover of FIG. 9 with a peg accessory used for holding a spare roll of toilet paper in accordance with an embodiment of the disclosure.
Figure 16:
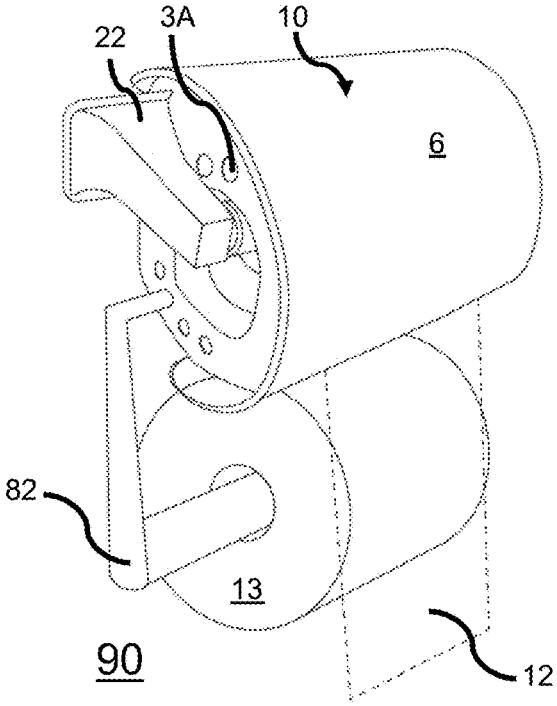
FIG. 16 is the paper roll cover and peg accessory of FIG. 15 further illustrating the peg accessory holding a spare roll of toilet paper in accordance with an embodiment of the disclosure.

Referring to FIG. 15, a paper roll dispenser 80 similar to the assembly 30 of FIG. 9 includes a typical wall mounted set of brackets 22 used for a toilet paper roll that gets mounted on a spindle (not shown) between the brackets 22. FIG. 15 further illustrates the assembly 80 including the paper roll cover 10 adjacent to a wall and using the brackets 22. As in FIG. 1, the paper roll cover 10 in FIG. 15 includes the cover member 6 and side walls with the plurality of apertures 3A surrounding the central large aperture. In this embodiment, a peg accessory 82 in the form of a spare toilet paper roll holder is shown. FIG. 16 further illustrates an assembly 90 that includes the paper roll cover 10, the peg accessory 82 and a spare toilet paper roll 13 mounted on the peg accessory 82 serving as the spare toilet paper roll holder. The main toilet paper roll 12 is illustrated as being dispensed above the spare toilet paper roll 13.

Figure 17:
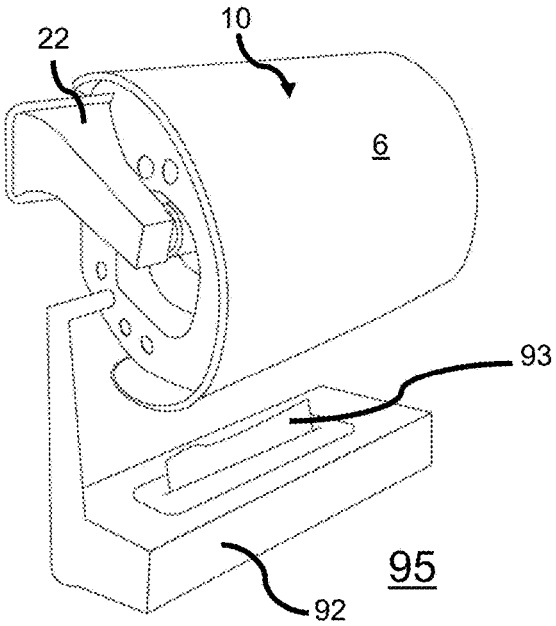
FIG. 17 is the paper roll cover of FIG. 9 with a peg accessory used for holding a tissue paper dispenser in accordance with an embodiment of the disclosure

FIG. 17 illustrates an assembly 95 including an assembly similar to the assembly 30 of FIG. 9 including the typical wall mounted set of brackets 22, and the paper roll cover 10 mounted on a wall using the brackets 22. As in FIG. 1, the paper roll cover 10 in FIG. 17 includes the cover member 6 and side walls with the plurality of apertures 3A surrounding the central large aperture. In this embodiment, a peg accessory 92 in the form of a tissue paper dispenser is shown. The tissue paper dispenser can be prefilled with tissues 93 and the accessory can serve as a disposable device or alternatively the dispenser can be configured as a holder of a tissue paper box or of tissue paper itself.

Figure 18:
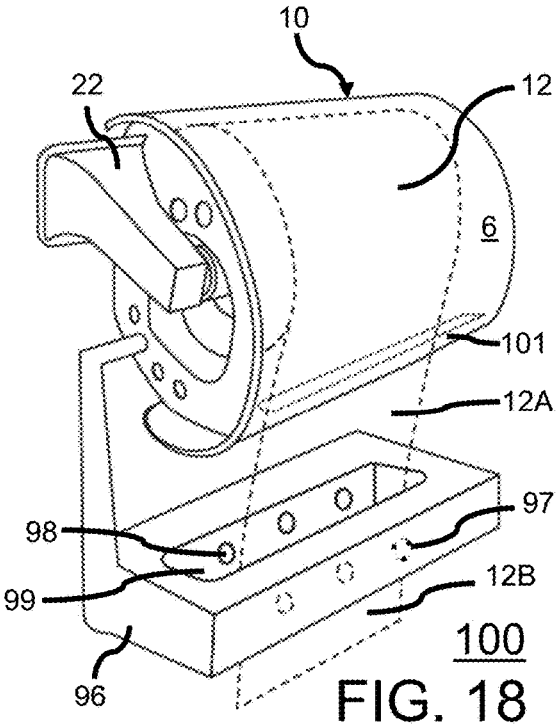
FIG. 18 is the paper roll cover of FIG. 9 with a peg accessory used for holding a light sanitizing device that sanitizes paper that is sanitized from a toilet paper roll in accordance with an embodiment of the disclosure.

FIG. 18 illustrates an assembly 100 including an assembly similar to the assembly 30 of FIG. 9 including the typical wall mounted set of brackets 22, and the paper roll cover 10 mounted on a wall using the brackets 22. As in FIG. 1, the paper roll cover 10 in FIG. 18 includes the cover member 6 and side walls with the plurality of apertures 3A surrounding the central large aperture. In this embodiment, a peg accessory 96 in the form of a paper sanitizer is shown. The peg accessory 96 can include a plurality of lights 97 and 98 that can be shined on either side of the dispense toilet paper. The plurality of lights 97 and 98 can be ultra-violet lights or other lights of different wavelengths used for sanitizing the surface of either side of the dispensed toilet paper. The pre-sanitized paper 12A being dispensed from above the peg accessory 96 can be fed through the peg accessory 96 and after being exposed to light comes out of the peg accessory 96 as sanitized paper 12B. The peg accessory 96 can also include a sensor to detect when paper exists in a slot 99 within the peg accessory 96. In some embodiments, the assembly can alternatively or additionally include a plurality of (sanitizing) lights 101 that can be placed on the internal side of the cover of the cover member 6 and most likely near the horizontal lip portion or cutting edge of the cover member 6. In this manner, the lights 101 can stay hidden if the material for the cover member 6 is opaque while still providing the function of sanitizing at least one side of the paper 12 of the paper roll. In some embodiments, the peg accessory 96 is not used and only the plurality of lights 101 is used to sanitize the paper 12. In some embodiments, the plurality of lights 101 can work collaboratively with the plurality of lights 98 and 97 to sanitize the paper 12. In some embodiments, the plurality of lights 101 can work collaboratively with just the plurality of lights 98 to sanitize the paper 12. In some embodiments, the plurality of lights 101 can work collaboratively with just the plurality of lights 97 to sanitize the paper 12 particularly on a single side (e.g., the external facing side).

In some embodiments, the paper roll cover can be formed by using 3 dimensional printing or a 3-D printer. In other embodiments, the paper roll cover can be formed using a molding process such as single shot or double shot molding.

As noted above, the left side wall and right side wall of the paper roll cover can include at least the plurality of apertures formed on an upper rear quadrant of the left and right side walls or the left side wall and right side wall include at least the plurality of apertures formed on an upper half and lower front quadrant of the left and right side walls. Other configurations are certainly contemplated. Generally, the plurality of apertures in the right side wall or the left side wall are configured to fit pegs to adjust the paper cover roll to brackets mounted on a wall or to a stand alone paper roll stand without requiring any mounting of the paper roll cover itself to any wall. In other words, the plurality of apertures in the right side wall or the left side wall are configured to fit pegs to adjust the paper cover roll to brackets mounted on a wall and alternatively to a stand alone paper roll stand.

It will be appreciated by those skilled in the art that the present invention can be embodied in other specific forms without departing from the spirit or essential characteristics thereof. The presently disclosed embodiments are therefore considered in all respects to be illustrative and not restricted. Modifications and variations are possible in light of the above teachings or may be acquired from practicing of the disclosure, without departing from the breadth or scope.

What is claimed is:

1. A paper roll cover, comprising:

a cover member;

a left side wall having a plurality of peg holes substantially around a central large aperture;

a right side wall having a plurality of peg holes substantially around a central large aperture;

wherein the left side wall is configured to attach to a left side of the cover member and the right side wall is configured to attach to a right side of the cover member; and wherein the cover member includes at least a left overhang portion that overhangs the left side wall or a right overhang portion that overhangs the right side wall.

2. The paper roll cover of claim 1, wherein the paper roll cover is formed as a unitary piece.

3. The paper roll cover of claim 1, wherein the paper roll cover is made of plastic or polyurethane.

4. The paper roll cover of claim 1, wherein the left side wall and right side wall each include a vertically flat portion configured to abut against a wall.

5. The paper roll cover of claim 1, wherein the cover member is arranged and configured to cover approximately 25 percent of a toilet paper roll.

6. The paper roll cover of claim 1, wherein the cover member includes a horizontal lip portion or cutting edge portion configured to facilitate cutting of paper from a paper roll.

7. The paper roll cover of claim 1, wherein the cover member includes a left overhang portion that overhangs the left side wall and a right overhang portion that overhangs the right side wall.

8. The paper roll cover of claim 1, wherein the left side wall and right side wall include at least the plurality of peg holes formed on an upper rear quadrant of the left and right side walls and wherein the plurality of peg holes are configured and arranged for receiving one or more pegs.

9. The paper roll cover of claim 1, wherein the left side wall and right side wall include at least the plurality of peg holes formed on an upper half and lower front quadrant of the left and right side walls and wherein the plurality of peg holes are configured and arranged for receiving one or more pegs.

10. The paper roll cover of claim 1, wherein the plurality of peg holes in the right side wall or the left side wall are sufficient in numbers to accommodate the paper roll cover to brackets mounted on a wall and alternatively to a stand alone paper roll stand.

11. The paper roll cover of claim 1, wherein the plurality of peg holes in the right side wall or the left side wall are configured and arranged to accommodate a peg holding other bathroom accessories.

12. The paper roll cover of claim 1, wherein the plurality of peg holes are arranged in an off-center fashion in the left side wall or the right side wall and configured for receiving one or more pegs.

13. The paper roll cover of claim 1, wherein the cover member includes a horizontal lip portion configured to facilitate cutting of paper from a toilet paper roll and wherein the horizontal lip portion is arranged and constructed to be at a point where a toilet paper segment vertically drops off from a toilet paper roll.

14. The paper roll cover of claim 1, wherein the paper roll cover is formed as a unitary piece formed of plastic.

15. The paper roll cover of claim 1, wherein the paper roll cover is formed by 3 dimensional printing.

16. The paper roll cover of claim 1, wherein the cover member is arranged and configured to cover approximately 25 percent of a toilet paper roll and wherein the cover member includes a horizontal lip portion or cutting edge portion configured to facilitate cutting of paper from a toilet paper roll.

17. The paper roll cover of claim 1, wherein the left side wall and right side wall include at least the plurality of apertures formed on an upper rear quadrant of the left and right side walls or wherein the left side wall and right side wall include at least the plurality of apertures formed on an upper half and lower front quadrant of the left and right side walls.

18. The paper roll cover of claim 1, wherein the plurality of apertures in the right side wall or the left side wall are configured and arranged to fit pegs enabling the adjustment of the paper roll cover to brackets mounted on a wall and alternatively to a stand alone paper roll stand.

19. A paper roll cover, comprising:

a cover member;

a left side wall having a plurality of apertures peripherally around a central large aperture;

a right side wall having a plurality of apertures peripherally around a central large aperture;

wherein the left side wall is arranged and configured to reside on a left side of the cover member and the right side wall is arranged and configured to reside a right side of the cover member; and wherein the plurality of apertures are peg holes arranged and constructed in the right side wall or the left side wall in sufficient numbers using one or more pegs to mount the paper roll cover to brackets mounted on a wall and alternatively to mount the paper roll cover to a stand alone paper roll stand.

20. A paper roll cover, comprising:

a cover member;

a left side wall having a plurality of apertures peripherally around a central large aperture;

a right side wall having a plurality of apertures peripherally around a central large aperture;

wherein the left side wall is arranged and configured to reside on a left side of the cover member and the right side wall is arranged and configured to reside a right side of the cover member; and wherein the plurality of apertures in the right side wall or the left side wall are configured and arranged enabling a fitting of one or more pegs allowing an adjustment of the paper roll cover to brackets mounted on a wall and alternatively allowing an adjustment of the paper roll cover to a stand alone paper roll stand.

* * * * *